US005921119A

United States Patent [19]

Myers et al.

[11] Patent Number: 5,921,119

[45] Date of Patent: Jul. 13, 1999

[54] POP-OUT HANDLE LOCK ASSEMBLY

[75] Inventors: Gary L. Myers, Monee; Ratomir Zivovic, Chicago, both of Ill.

[73] Assignee: Fort Lock Corporation, River Grove, Ill.

[21] Appl. No.: 08/686,846

[22] Filed: Aug. 1, 1996

[51] Int. Cl.[6] ..... E05B 3/04; E05B 13/10

[52] U.S. Cl. ..... 70/208; 70/418; 70/422; 74/528; 292/336.3; 292/348; 292/350; 292/353

[58] Field of Search ..... 70/208, 422, 204, 70/418; 292/349, 353, 355, 336.3, 347–343, DIG. 27, DIG. 64; 74/528

[56] References Cited

U.S. PATENT DOCUMENTS

| | | | |
|---|---|---|---|
| 1,877,798 | 9/1932 | Briggs et al. | 292/353 |
| 2,138,856 | 12/1938 | Harp | 70/422 |
| 2,242,508 | 5/1941 | Ching | 292/353 |
| 2,252,855 | 8/1941 | Lasch | 292/353 |
| 2,339,980 | 1/1944 | Cloutier | 70/422 |
| 2,755,106 | 7/1956 | Brennan et al. | 292/353 |
| 3,017,762 | 1/1962 | Kubik | 70/422 |
| 3,089,330 | 5/1963 | Kerr . | |
| 3,188,124 | 6/1965 | Pestka et al. | 292/349 |
| 3,234,765 | 2/1966 | Kerr | 70/208 |
| 3,316,742 | 5/1967 | Wellekens . | |
| 3,550,412 | 12/1970 | Pitel et al. . | |
| 3,829,139 | 8/1974 | Storlie | 292/349 |
| 4,195,502 | 4/1980 | Best et al. | 70/422 X |
| 4,550,581 | 11/1985 | Best et al. | 70/422 |
| 4,552,001 | 11/1985 | Roop | 70/208 |
| 4,667,994 | 5/1987 | Foshee | 70/422 X |
| 4,760,721 | 8/1988 | Steinbach | 70/208 |
| 4,835,998 | 6/1989 | Steinbach | 70/208 |
| 4,899,561 | 2/1990 | Myers | 70/208 |
| 4,974,888 | 12/1990 | Childers | 292/251 |
| 4,993,247 | 2/1991 | Minemura | 70/208 |
| 5,036,575 | 8/1991 | Campion et al. | 70/224 X |
| 5,038,588 | 8/1991 | Hall | 70/208 |
| 5,080,407 | 1/1992 | Evers | 292/DIG. 27 X |
| 5,106,251 | 4/1992 | Steinbach | 411/433 |
| 5,160,180 | 11/1992 | Mlynarczyk | 292/252 |
| 5,548,982 | 8/1996 | Rawling | 70/208 |

FOREIGN PATENT DOCUMENTS

| | | | |
|---|---|---|---|
| 549856 | 7/1993 | European Pat. Off. | 292/353 |
| 357452 | 11/1961 | Switzerland | 292/353 |
| 17918 | 11/1889 | United Kingdom | 292/353 |
| 927300 | 5/1963 | United Kingdom | 292/353 |

*Primary Examiner*—Lloyd A. Gall
*Attorney, Agent, or Firm*—Banner & Witcoff, Ltd.

[57] ABSTRACT

A pop-out handle lock assembly having a frangible and easily replaceable handle portion is provided. As with other pop-out handle lock assemblies, the pop-out handle lock assembly of the present invention is used to lock a movable closure member relative to a stationary object such as a vending machine door and a vending machine cabinet, respectively. In operation, the pop-out handle lock assembly of the present invention is received by a housing which is mounted to the movable closure member. The housing, in particular, has a longitudinal slot formed therethrough, and includes a front face portion which abuts the movable closure member and a generally perpendicular rear guide portion which extends into the movable closure member. The pop-out lock assembly of the present invention includes a stem portion and a frangibly attached handle portion. The pop-out handle lock assembly also includes a lock plug assembly rotatable disposed within a bore in the stem portion and a threaded lock stud operatively connected thereto. In use, the handle portion may be frangibly detached from the stem portion without yielding access to the stationary object by applying a prying force between the handle portion and the front face portion of the housing. Also, an auxiliary replacement handle portion provides a convenient, simple, and inexpensive way to replace the handle portion once it has been tampered with and detached in the field.

8 Claims, 5 Drawing Sheets

POP-OUT HANDLE LOCK ASSEMBLY

TECHNICAL FIELD OF THE INVENTION

The present invention relates generally to locking devices and, more particularly, to a pop-out handle lock assembly for use in vending machines and the like.

BACKGROUND OF THE INVENTION

Pop-out handle lock assemblies are well known in the art. Such lock assemblies are commonly used, for example, to prevent unauthorized access to vending machines (e.g., refrigerated pop machines, food machines, candy machines, etc.), coin changers, mass transit collection systems, outdoor storage facilities, utility boxes, and bicycle storage modules. In fact, pop-out handle lock assemblies are so well known in the art that dimensional standards have been set forth by both NAMA (i.e., the National Automatic Merchandising Association) and ASTM (i.e., the American Society of Testing Materials). In addition to these dimensional standards, several patents have issued which disclose various features of such pop-out handle lock assemblies including, for example, U.S. Pat. Nos. 3,089,330 (Kerr), 3,550,412 (Pitel et al.), 4,552,001 (Roop), 4,760,721 (Steinbach), and 4,899,561 (Myers).

Conventional pop-out handle lock assemblies include two generally T-shaped components which cooperate to secure a movable cabinet door to a stationary cabinet, or the like. More specifically, such pop-out lock assemblies typically comprise a generally T-shaped housing mounted to the door and generally T-shaped lock assembly which is received by and nested within the generally T-shaped housing. The lock assembly, in particular, usually comprises an outer shell having integral handle and stem portions and a bore formed therethrough, a lock plug assembly rotatably disposed in the bore of the outer shell, a latch bolt operatively connected to the lock plug assembly, and a lock stud reciprocally disposed within and protruding from the bore of the outer shell and operatively connected to the lock plug assembly. The lock stud usually includes a threaded end which is adapted to be received by a threaded aperture disposed within the cabinet. The housing, on the other hand, usually comprises a front face portion which is mounted to the exterior surface of the door and an integral rear guide portion which projects rearwardly through an opening in the door. A slot formed through the housing and along the longitudinal axis of the integral rear guide portion slidably receives the stem portion of the outer shell. In addition, a radial aperture formed in the rear guide portion of the housing selectively receives the latch bolt.

The cabinet door may be retained closed with respect to the cabinet by moving the lock assembly into its locked position. Alternatively, the cabinet door may be opened with respect to the cabinet by moving the lock assembly into its unlocked position. In operation, the lock assembly is moved into its locked position by rotating the handle portion until the lock stud is completely received by the threaded aperture of the cabinet, by pushing the stem portion into the longitudinal slot of the housing such that handle portion is received by the recess disposed in the front face portion of the housing, and by rotating the lock plug assembly until the latch bolt engages the radial aperture disposed in the rear guide portion of the housing. When the lock assembly is in its unlocked position, however, the latch bolt does not engage the radial aperture. Instead, a coil spring compressibly disposed between the stem portion of the lock assembly and the rear guide portion of the housing causes the lock assembly to partially eject from the housing. Once ejected, the handle portion may be grasped and rotated which enables the threaded end of the lock stud to be withdrawn from the threaded aperture of the cabinet. In this way, the cabinet door may be opened with respect to the cabinet.

Because valuable goods are customarily stored within the cabinet (e.g., currency, tokens, products, etc.), the need for security is high. Most known pop-out handle lock assemblies, however, can be defeated by forced entry. For example, by applying a prying force to the handle portion with a crowbar or the like, a vandal or thief may defeat the pop-out handle lock assembly and gain access to the contents of the cabinet. Even if access is not gained in this way, the pop-out handle lock assembly will either be completely destroyed or extensively damaged. Alternatively, the vandal or thief may break open the front panel of the cabinet door (or a product select button disposed in the cabinet door) and then manipulate and self-defeat the latch bolt with a screwdriver or the like in order to cause the handle portion to eject from the housing. In either event, the pop-out handle lock assembly and/or the cabinet door will require immediate replacement. Such replacement, however, is expensive, labor intensive, and time consuming.

OBJECTS OF THE INVENTION

Accordingly, a primary object of the present invention is to provide a pop-out handle lock assembly that discourages forced entry.

Another object of the present invention is to provide a pop-out handle lock assembly that frustrates thieves and vandals.

A related object of the present invention is to provide a pop-out handle lock assembly that minimizes the amount damage inflicted to the lock assembly and the cabinet door during an attempted theft or an act of vandalism.

A more specific object of the present invention is to provide a pop-out handle lock assembly that discourages subsequent damage once it has been initially tampered with.

A further object of the present invention is to provide a pop-out handle lock assembly that is easier to break and less expensive to replace than the cabinet door.

An additional another object of the present invention is to provide a pop-out handle lock assembly having a tamper evident feature.

Still another object of the present invention is to provide a pop-out handle lock assembly that is relatively simple and inexpensive to manufacture, install, and replace.

Yet another object of the present invention is to provide a pop-out handle lock assembly that is dependable and convenient to use.

These and other objects, features, and advantages of the present invention will become apparent upon reading the following detailed description of a preferred exemplified embodiment and upon reference to the accompanying drawings.

SUMMARY OF THE INVENTION

The above objects are accomplished by providing a pop-out handle lock assembly with a frangibly attached and easily replaceable handle portion. As with other pop-out handle lock assemblies, the pop-out handle lock assembly of the present invention is used to lock a movable closure member relative to a stationary object such as a vending machine door and a vending machine cabinet, respectively. In operation, the pop-out handle lock assembly of the present invention is received by a housing which is mounted to the movable closure member. The housing, in particular, has a longitudinal slot formed therethrough, and includes a front face portion which abuts the movable closure member and a generally perpendicular rear guide portion which extends into the movable closure member. The pop-out lock assembly of the present invention includes a stem portion and a frangibly attached handle portion. The pop-out handle lock assembly also includes a lock plug assembly rotatable disposed within a bore in the stem portion and a threaded lock stud operatively connected thereto. In operation, the stem portion is rotatably and slidably received by the longitudinal slot of the housing, the frangibly attached handle portion is received by a shallow recess formed in the front face portion of the housing, and the threaded lock stud engages a threaded aperture disposed within the stationary object which permits the movable closure member to be securely locked to the stationary object.

If a sufficient prying force is applied to the frangibly attached handle portion during an attempted theft or an act of vandalism, however, the handle portion will snap-off from the stem portion. Although the handle portion will now be missing, the moveable close member will remain secured to the stationary object which will likely cause the thief or vandal to become discouraged in his or her efforts. Once sufficiently frustrated, the thief or vandal will discontinue all interference with the machine. In this way, the frangibly attached handle portion minimizes the amount of damage inflicted upon both the pop-out handle lock assembly and the movable closure member. The frangibly attached handle portion also provides a tamper evident feature.

BRIEF DESCRIPTION OF THE DRAWINGS

In the drawings, wherein similar reference numerals denote similar elements throughout the several views.

While the present invention will be described and disclosed in connection with certain preferred embodiments and procedures, it is not intended to limit the invention to these specific embodiments. On the contrary, it is intended to cover all such alternatives, modifications, and equivalents that fall within the spirit and scope of the present invention as defined by the appended claims.

DETAILED DESCRIPTION OF THE PREFERRED EMBODIMENT

Figure 1:
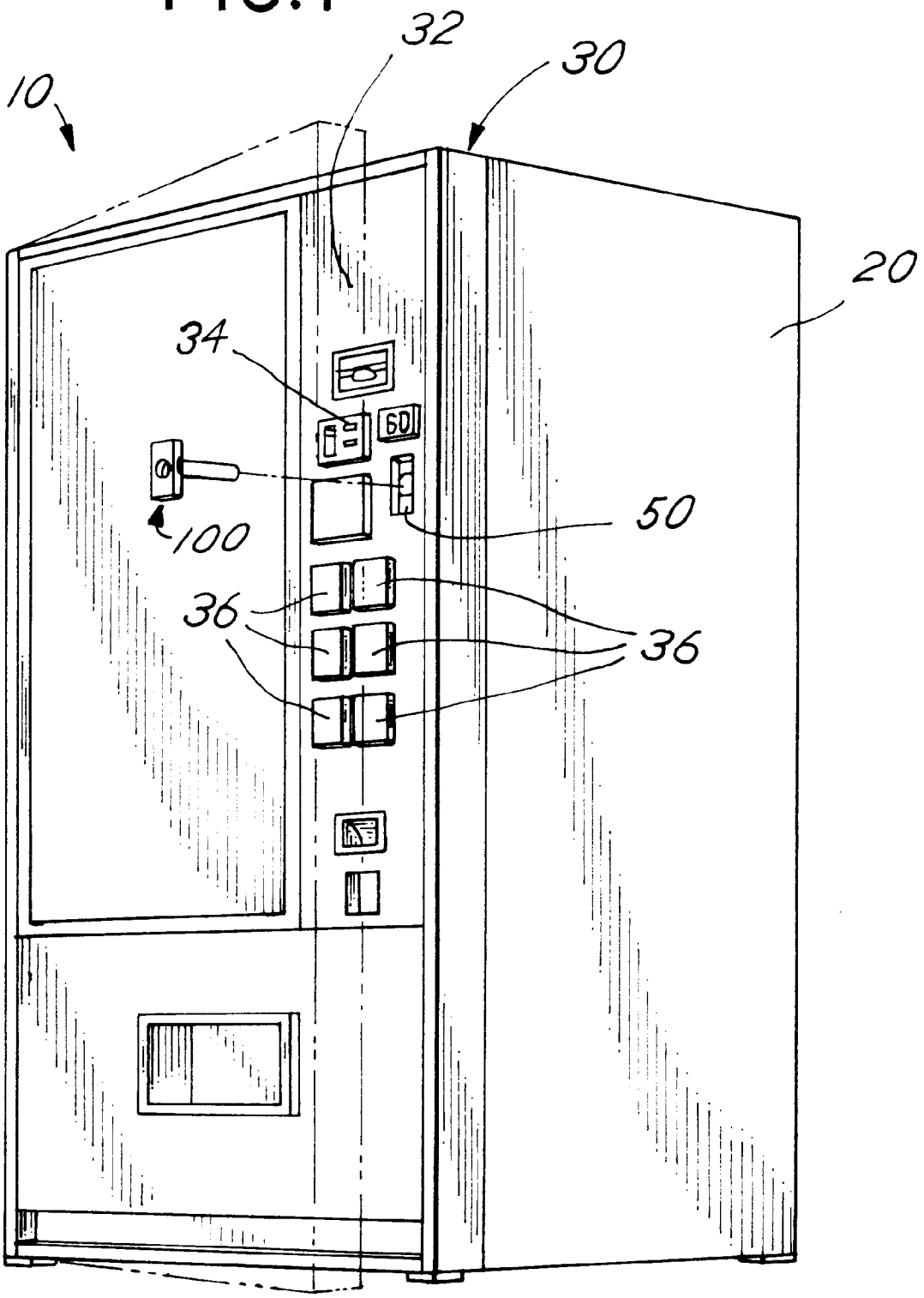
FIG. 1 is a perspective view of a typical vending machine having a housing mounted thereto and incorporating a pop-out handle lock assembly constructed in accordance with the teachings of the present invention.

Referring now to the drawings, there is shown in FIG. 1 a typical vending machine 10 having a stationary cabinet 20 and a movable closure member (or door) 30 hingedly attached thereto. As is customary in the art, the cabinet 20 includes a product compartment chamber (not shown) where the products to be vended are stored. In addition, the cabinet door 30 includes a front panel (or exterior surface) 32 having a coin slot 34 and product select buttons 36. A coin collection box (not shown), positioned in registry with the coin slot 34 and disposed within the cabinet 20, is provided for collecting coins deposited into the vending machine 10. In use, a customer may conveniently purchase and receive a desired product from the vending machine 10 by inserting coins into the coin slot 34 and pressing the appropriate product select button 36.

A pop-out handle lock assembly constructed in accordance with the teachings of the present invention and designated generally by reference numeral 100 is provided for locking the cabinet door 30 with respect to the cabinet 20. In this way, unauthorized access to the contents of the cabinet 20 (i.e., the coin collection box and the products to be vended) is prevented.

Figure 2:
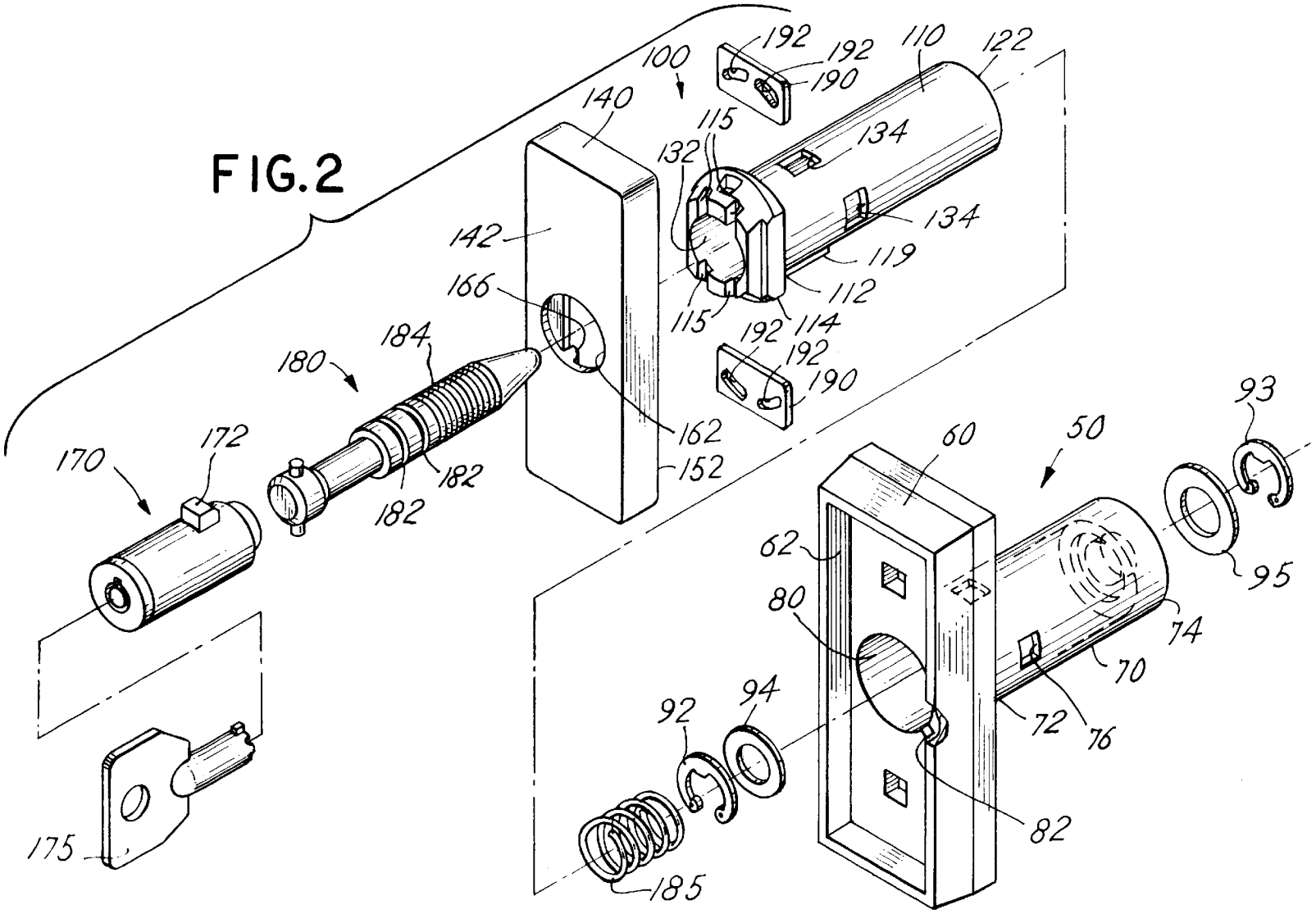
FIG. 2 is an exploded front perspective view of the pop-out handle lock assembly depicted in FIG. 1, here showing a first embodiment (i.e., a plant-assembled embodiment) of a handle portion frangibly attached to a stem portion by snap-on retaining clips.

As shown in FIGS. 1 and 2, the pop-out handle lock assembly 100 of the present invention is received by a generally T-shaped housing 50 which is mounted to the cabinet door 30. As best shown in FIG. 2, the housing 50 includes a front face portion 60 and a generally perpendicular rear guide portion 70. The housing 50 also has a longitudinal slot 80 formed therethrough. In use, the front face portion 60 of the housing 50 abuts the front panel 32 of the cabinet door 30—as shown, for example, in FIG. 1—while the rear guide portion 70 is disposed in the cabinet door 30 and projects inwardly toward the cabinet 20. More specifically, the front face portion 60 of the housing 50 is securely mounted to the front panel 32 of the cabinet door 30 with bolts, or the like (not shown), while the rear guide portion 70 is received by an opening (not shown) in the cabinet door 30. As best shown in FIG. 2, the front face portion 60 has a shallow, elongated, and generally rectangular recess 62 formed therein which projects away from the cabinet 20. The rear guide portion 70, meanwhile, includes a forward end 72, an aft end 74, and at least one radial aperture 76 disposed therebetween.

As best depicted in FIG. 2, the pop-out handle lock assembly 100 of the present invention includes a stem portion 110 and a handle portion 140. As is customary in the art, the stem portion 110 is adapted to be slidably received by the longitudinal slot 80 of the housing 50. The handle portion 140, on the other hand, is adapted to be received by the generally rectangular recess 62 formed in the front face portion 60 of the housing 50.

Figure 3:
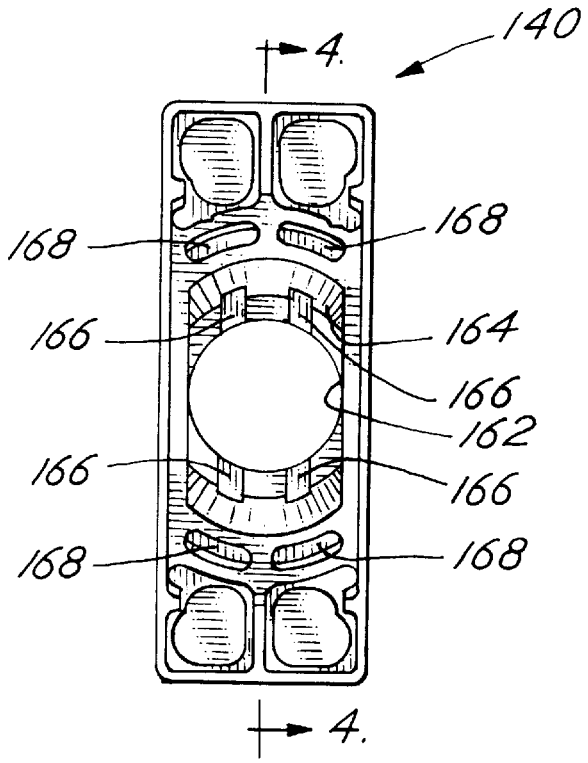
FIG. 3 is a rear elevational view of the handle portion depicted in FIGS. 2.
Figure 4:
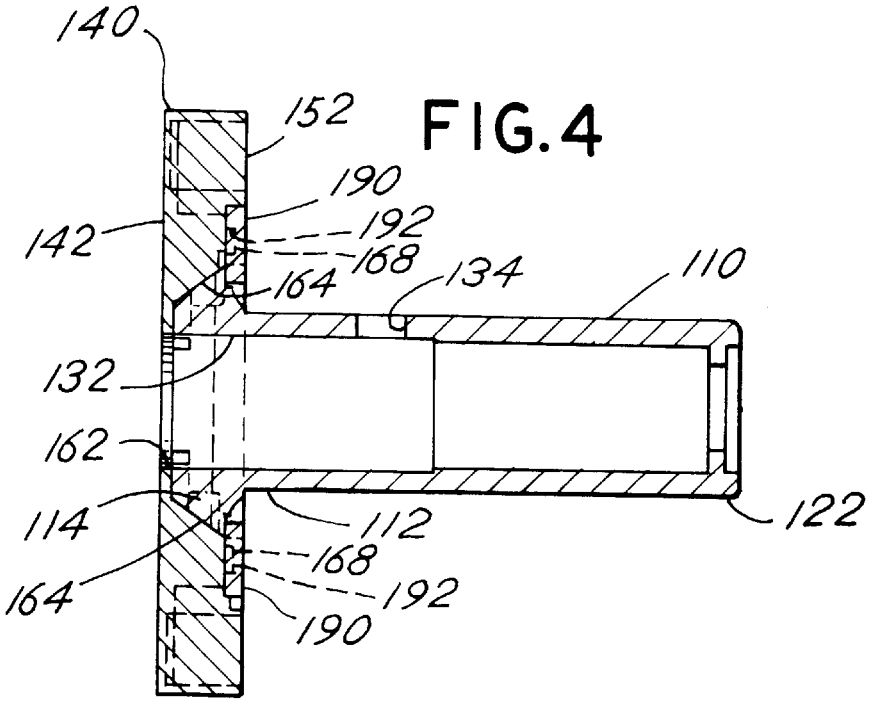
FIG. 4 is a cross-sectional view of the handle portion, the stem portion, and the snap-on retaining clips, as seen in the direction of line 4—4 in FIG. 3.

In the illustrated embodiment, the handle portion 140 of the lock assembly 100 is generally rectangular in configuration and includes an anterior side 142, a posterior side 152, and generally central hole 162 formed therethrough. As best shown in FIGS. 3 and 4, the posterior side 152 of the handle portion 140 includes a generally obround cavity 164 with ribs 166 and a plurality of lands 168 disposed around the cavity 164. In use, the handle portion 140 is movable between a first position wherein the posterior side 152 of the handle portion 140 is snugly received by and nested within the shallow elongated recess 62 in the front face portion 60 of the housing 50 and a second position wherein the posterior side 152 of the handle portion 140 is spaced-apart therefrom.

The stem portion 110 of the lock assembly 100 is generally cylindrical in configuration and includes a first end 112, a second end 122, a bore 132 formed therethrough, and at least one aperture 134. As best shown in FIGS. 2 and 4, the bore 132 of the stem portion is aligned with the hole 162 of the handle portion 140. In addition, the first end 112 of the stem portion 110 includes a generally obround shoulder 114 which is adapted to be received by the complementally-shaped cavity 164 disposed in the posterior side 152 of the handle portion 140. As shown in FIGS. 2 and 3, a pair of grooves 115 are formed in the shoulder 114 of the stem portion 110 which are adapted to receive the ribs 166 formed in the cavity 164 of the handle portion 140. As is customary in the art, the stem portion 110 also includes a rail 119 which is received by a rail channel 82 formed within the longitudinal slot 80 of the housing 50. Because the rail 119 has a relatively short length, both the handle portion 140 and the stem portion 110 are rotatable with respect to the longitudinal slot 80 of the housing 50 when the handle portion 140 is in the second position (i.e., when the posterior side 152 of the handle portion 140 is spaced-apart from the recess 62 formed in the front face portion 60 of the housing 50).

In accordance with certain objects of the present invention, the handle portion 140 of the lock assembly 100 is frangibly attached to the stem portion 110. As a consequence, if a sufficient prying force is applied between the handle portion 140 and the front face portion 60 of the housing 50 during an attempted theft or vandalism, the handle portion 140 will snap-off from the stem portion 110. Should this occur, the contents of the cabinet 20 will remain unaccessible to the thief or vandal because the lock assembly 100 is not yet be defeated. At this point, however, the thief or vandal will likely become discouraged with his or her lack of progress and cease all interference with the vending machine 10 and/or the lock assembly 100. In this way, the lock assembly 100 of the present invention discourages forced entry, frustrates thieves and vandals, and minimizes damage not only to the lock assembly 100, but also to the cabinet door 30.

In the first illustrated embodiment, the handle portion 140 of the lock assembly 100 is frangibly attached to the stem portion 100 by a pair of snap-on retaining clips 190 which fit over the shoulder 114 of the stem portion 110 and releasibly attach to posterior side 152 of the handle portion 140. As best shown in FIGS. 2 and 3, the snap-on retaining clips 190 include openings 192 which are complemental in shape to the lands 168 formed on the posterior side 152 of the handle portion 140. As such, the snap-on retaining clips 190 may be conveniently press-fit onto the posterior side 152 of the handle portion 140. More specifically, once the shoulder 114 is received by the complementally-shaped cavity 164 in the posterior side 152 of the handle portion 140, the snap-on retaining clips 190 may be press-fit onto the lands 168 by forcing the openings 192 of the clips 190 through the lands 168 of the handle portion 140. The shoulder 114, of course, should be arranged between the cavity 164 of the handle portion 140 and the snap-on retaining clips 190, as illustrated, for example, in FIG. 4. In keeping with an important aspect of the present invention, the snap-on retaining clips 190 will disengage from the lands 168 of the handle portion 140 when a sufficient prying force is applied between the posterior side 152 of the handle portion 140 and the recess 62 formed in the front face portion 60 of the housing 50. In this way, the handle portion 140 is detachable from the stem portion 110 during an act of vandalism or an attempted theft.

As is customary in the art, the lock assembly 100 of the present invention also includes a lock plug assembly 170 which is rotatably received by the bore 132 of the stem portion 110. As shown in FIG. 2, the lock plug assembly 170 includes a latch bolt 172 which is actuated by a properly-fitting key 175. More specifically, when the lock plug assembly 170 is rotated by the key 175, the latch bolt 172 moves between an extended position wherein the latch bolt 172 extends through one of the apertures 134 formed in the stem portion 110 and engages one of the radial apertures 76 disposed in the rear guide portion 70 of the housing 50 and a retracted position wherein the latch bolt 172 is substantially flush with the stem portion 110. When the latch bolt 172 is in the extended position, the handle portion 140 is retained in the first position (i.e., the posterior side 152 of the handle portion 140 is retained against the recess 62 formed in the front face portion 60 of the housing 50) and the stem portion 110 is prevented from rotating and axially sliding with respect to the longitudinal slot 80 of the housing 50. When the latch bolt 172 is in the retracted position, however, the stem portion 110 and the frangible attached handle portion 140 may rotate and axially slide with respect to the longitudinal slot 80 of the housing 50. In this way, the extended and retracted positions of the latch bolt 172 correspond to the first and second positions of the handle portion 140.

In keeping with an important aspect of the present invention, the shoulder 114 of the stem portion 110 blocks access to the latch bolt 172 after the handle portion 140 has been detached from the stem portion 110. In this way, a thief or vandal is prevented from manipulating the latch bolt 172 and defeating the lock assembly 100 with a screwdriver or the like.

The lock assembly 100 of the present invention also includes a lock stud 180 which is operatively connected to the lock plug assembly 170 and is rotatably disposed within the bore 132 of the stem portion 110. As depicted in FIG. 2, the lock stud 180 is longitudinally fixedly mounted within the bore 132 of the stem portion 110 by two sets of generally C-shaped retaining rings 92 and 93 and washers 94 and 95. In practice, each washer 94 and 95 is arranged on opposite sides of a radial flange (not shown) formed at the aft end 74 of the rear guide portion 70, and each retaining ring engages a groove 182 formed in the lock stud 180. This arrangement retains the lock stud 180 at a predetermined longitudinal location within the bore 132 of the stem portion 110 but allows the lock stud 180 to rotate with respect to the stem portion 110 and the rear guide portion 70 of the housing 50. As is customary in the art, the lock stud 180 also includes a threaded portion 184 which is adapted to engage a threaded aperture (not shown) disposed within the vending machine cabinet 20. Thus, when the threaded portion 184 of the lock stud 180 is received by and rotated with respect to the threaded aperture of the cabinet 20, the cabinet door 30 is urged toward the cabinet 20. In addition, when the threaded portion 184 of the lock stud 180 is completely received by the threaded aperture of the cabinet 20, the cabinet door 30 is retained closed against the cabinet 20. In this way, unauthorized access to the cabinet 20 of the vending machine 10 is conveniently prevented.

A compression spring 185 is also provided for biasing the handle portion 140 in the second position (i.e., spaced-apart from the front face portion 60 of the housing 50). As best shown in FIG. 2, the spring 185 is compressibly disposed between the second end 122 of the stem portion 110 and the aft end 74 of the rear guide portion 70. More specifically, the spring 185 is interposed between the forwardmost retaining clip 92 and the second end 122 of the stem portion 110. Of course, when the stem portion 110 is fully inserted into the longitudinal slot 80 of the housing 50, the biasing provided by the spring 185 is overcome.

The lock assembly 100 of the present invention enables the cabinet door 30 to be locked with respect to the cabinet 20 in order to prevent unauthorized access to the contents of the cabinet 20 (i.e., to the product compartment chamber and the coin collection box). In particular, the cabinet door 30 may be locked by rotating the handle portion 140 until the lock stud 180 is completely received by the threaded aperture of the cabinet 20, by pushing or inserting the stem portion 110 into the longitudinal slot 80 of the housing 50 such that the biasing provided by spring 185 is overcome and the handle portion 140 is received by the recess 62 disposed in the front face portion 60 of the housing 50 (i.e., by moving the handle portion 140 into the first position), and by rotating the lock plug assembly 170 until the latch bolt 172 engages the rearwardmost radial aperture 76 disposed in the rear guide portion 70 of the housing 50 (i.e., by moving the latch bolt 172 into the extended position).

Figure 5:
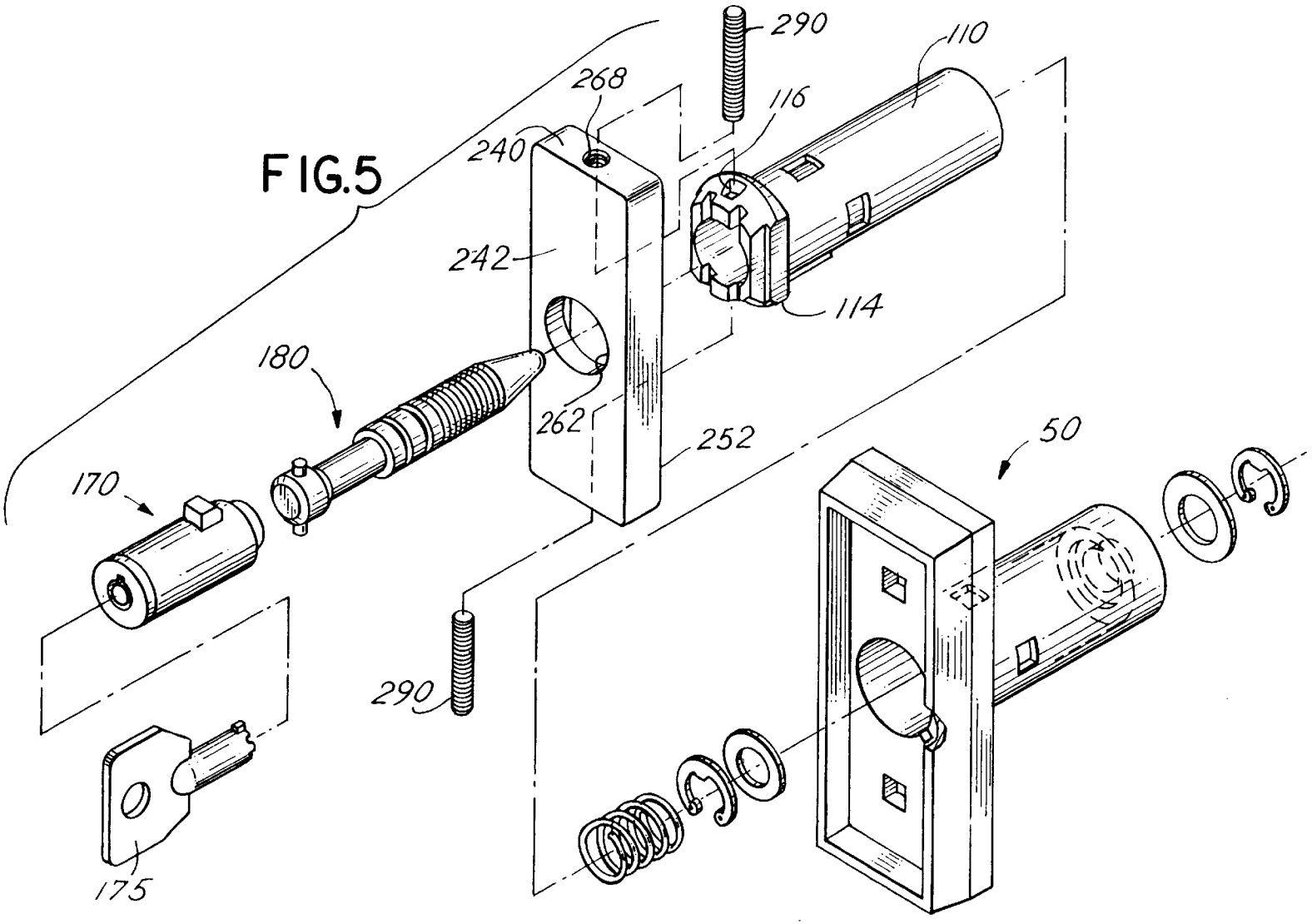
FIG. 5 is an exploded front perspective view of the pop-out handle lock assembly depicted in FIG. 1, here showing a second embodiment (i.e., an auxiliary or field-replaceable embodiment) of the handle portion frangibly attached to the stem portion by bolts.
Figure 6:
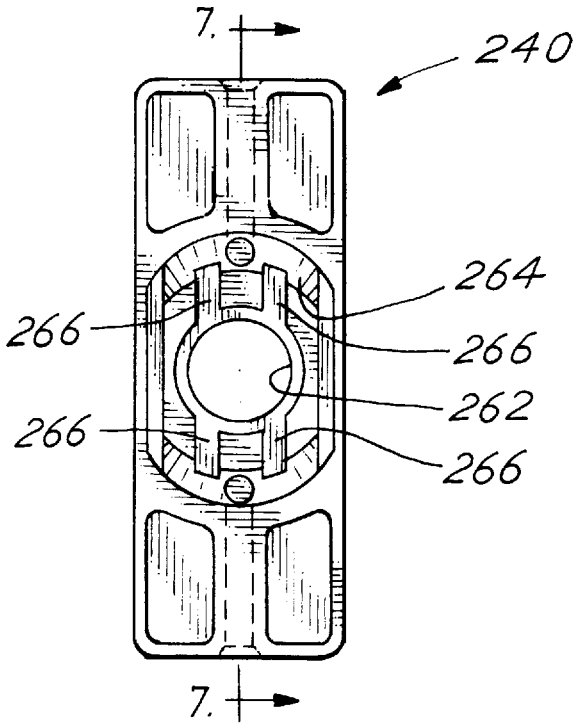
FIG. 6 is a rear elevational view of the handle portion depicted in FIG. 5.
Figure 7:
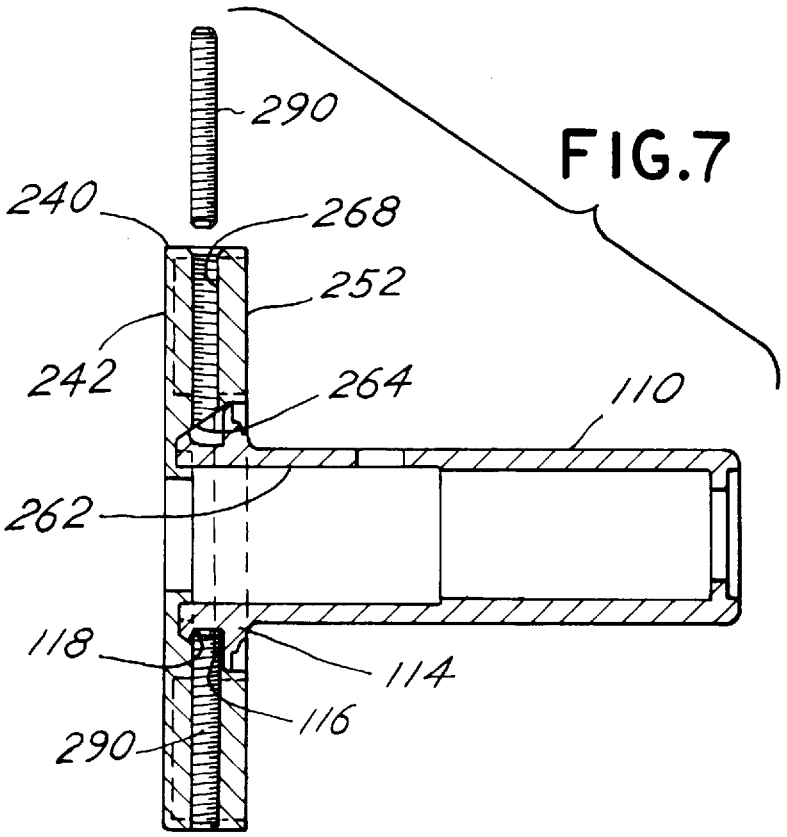
FIG. 7 is a cross-sectional view of the handle portion, the stem portion, and the bolts, as seen in the direction of line 7—7 in FIG. 6.

In keeping with an important aspect of the present invention, two embodiments of the handle portion are provided—namely a plant-assembled embodiment 140 (i.e., the embodiment depicted in FIGS. 2–4 and described above), and a field-replaceable embodiment 240 (i.e., the embodiment depicted in FIGS. 5–7). Aside from the two embodiments of the handle assemblies 140 and 240, the lock assemblies 100 depicted in FIGS. 2–4 and 5–7 are identical.

In practice, the first embodiment of the handle portion 140 is frangibly attached to the stem portion 110 through the use of press-fitting equipment. Such equipment is typically stationed, for example, at an assembly plant or a manufacturing facility. After the first embodiment of the handle portion 140 has been snapped-off in the field during an act of vandalism or an attempted theft, however, the first embodiment of the handle portion 140 may be conveniently replaced with the second embodiment of the handle portion 240.

Like the first embodiment, the second embodiment of the handle portion 240 is generally rectangular in configuration and includes an anterior side 242, a posterior side 252, and generally central hole 262 formed therethrough. As best shown in FIGS. 6 and 7, the posterior side 252 of the handle portion 240 includes a generally obround cavity 264 with ribs 266. Unlike the first embodiment, however, the second embodiment of the handle portion 240 includes a pair of threaded bolt holes 268 arranged on opposite ends of the handle portion 240 and extending into the cavity 264.

As shown, for example, in FIG. 5, a pair of hex socket headless bolts 290 are used to secure the second embodiment of the handle portion 240 onto the shoulder 114 of the stem portion 110. In particular, after the shoulder 114 is received by the complementally-shaped cavity 264 in the posterior side 252 of the handle portion 240, the bolts 290 are threaded through the bolt holes 268 of the handle portion 240 with a screwdriver or the like (not shown) until they are received by small notches 116 disposed in the shoulder 114 of the stem portion 110. In order to provide improved engagement between the notches 116 of the shoulder 114 and the bolts 290, the notches 116 may also include threaded side portions 118, as depicted, for example, in FIG. 7. This engagement between the bolts 290 and the notches 116 of the shoulder 114 provides the second embodiment of the handle portion 240 with a frangible attachment to the stem portion 110 (although somewhat less frangible than the first embodiment of the handle portion 140).

In accordance with an important aspect of the present invention, the second embodiment of the handle portion 240 may be advantageously installed onto the shoulder 114 of the stem portion 110 without first disassembling the lock assembly 100 from the cabinet 20. In addition, the second embodiment of the handle portion 240 may also be installed remotely (i.e., in the field) without using any specialized equipment (e.g., press-fitting equipment). In this way, the second embodiment of the handle portion 240 provides a field-replaceable or auxiliary form of the first embodiment of the handle portion 140 which is convenient, simple, inexpensive to replace.

What is claimed is:

1. A lock assembly for locking a movable closure member relative to a stationary object, the movable closure member having a housing mounted thereto for receiving the lock assembly, the housing having a longitudinal slot formed therethrough and including a front face portion which abuts the movable closure member and a generally perpendicular rear guide portion which extends into the movable closure member, the front face portion having a recess formed therein, the rear guide portion having an aft end, the lock assembly comprising:

a stem portion adapted to be slidably received by the longitudinal slot of the housing, the stem portion having a first end with a shoulder, a second end, and a bore formed therethrough;

a first handle portion adapted to be received by the recess in the front face portion of the housing and demountably attached to the shoulder of the stem portion with at least one snap-on retaining clip to form a generally T-shaped assembly, the first handle portion having an anterior side, a posterior side, and a hole formed therethrough, the hole of the first handle portion being aligned with the bore of the stem portion, the first handle portion being configured to break away from the shoulder of the stem portion and from said at least one snap-on retaining clip when a sufficient prying force is applied thereto; and an auxiliary replacement handle portion adapted to be attached to the shoulder of the stem portion with at least one bolt after the first handle portion has been detached therefrom.

2. The lock assembly as set forth in claim 1, wherein the shoulder of the stem portion is received by a complementally-shaped cavity disposed in the posterior side of the first handle portion.

3. The lock assembly as set forth in claim 1, wherein said at least one snap-on retaining clip fits over the shoulder of the stem portion and releasably attaches to the posterior side of the first handle portion.

4. The lock assembly as set forth in claim 1, wherein said at least one snap-on retaining clip includes at least one opening and the posterior side of the first handle portion includes at least one land which is complemental in shape to the opening in said at least one snap-on retaining clip.

5. The lock assembly as set forth in claim 4, wherein said at least one snap-on retaining clip is releasably attached to the posterior side of the first handle portion by press-fitting said at least one opening of said at least one snap-on retaining clip onto said at least one land of the first handle portion.

6. The lock assembly as set forth in claim 1, wherein said at least one bolt is received by at least one bolt hole disposed within the auxiliary replacement handle portion and by at least one notch disposed within the shoulder of the stem portion to attach the auxiliary replacement handle portion to the shoulder of the stem portion.

7. In a lock assembly for locking a movable closure member relative to a stationary object and of the type wherein a generally T-shaped housing is mounted to the movable closure member for receiving the lock assembly, the generally T-shaped housing including a front face portion which abuts the movable closure member, a rear guide portion which extends into the movable closure member, and a longitudinal slot formed therethrough which receives a stem portion of the lock assembly, the improvement comprising:

a first handle portion demountably attached to a shoulder on the stem portion with at least one snap-on retaining clip to form a generally T-shaped assembly and adapted to be received by a recess formed in the front face portion of the generally T-shaped housing, the first handle portion being configured to detach from the shoulder of the stem portion and from said at least one snap-on retaining clip when a sufficient prying force is applied thereto without causing damage to the movable closure member or to the remainder of the lock assembly; and a second replacement handle portion which is adapted to be attached to the stem portion after the first handle portion has been detached therefrom, the second replacement handle portion being attachable to the stem portion with at least one bolt.

8. In a method of locking a movable closure member relative to a stationary object, of the type wherein a generally T-shaped housing is mounted to the movable closure member for receiving a lock assembly, and wherein the generally T-shaped housing includes a front face portion which abuts the movable closure member, a rear guide portion which extends into the movable closure member, and a longitudinal slot formed therethrough which receives a stem portion of the lock assembly, the method comprising the acts of:

providing a first handle portion which is demountably attached to a shoulder on the stem portion of the lock assembly with at least one snap-on retaining clip to form a generally T-shaped assembly, the first handle portion being received by a recess formed in the front face portion of the housing and being configured to detach from the shoulder of the stem portion and from said at least one snap-on retaining clip when a sufficient prying force is applied thereto; and providing an auxiliary replacement handle portion which is attachable to the stem portion of the lock assembly after the first handle portion has been detached therefrom, the auxiliary replacement handle portion being attachable to the stem portion with at least one bolt.

* * * * *